US006032991A

United States Patent [19]

Yeh

[11] Patent Number: 6,032,991

[45] Date of Patent: Mar. 7, 2000

[54] ELECTRICALLY OPERABLE TUBULAR LOCK

[76] Inventor: Tsun-Tsai Yeh, No. 10, Chien-Hwa St., Hsinchu City, Taiwan

[21] Appl. No.: 09/300,679

[22] Filed: Apr. 27, 1999

[51] Int. Cl.[7] ..... E05B 59/00

[52] U.S. Cl. ..... 292/336.3; 292/144; 70/279; 74/625

[58] Field of Search ..... 70/280, 277, 279, 70/224; 292/336.3, 144, 201, DIG. 25; 74/625

[56] References Cited

U.S. PATENT DOCUMENTS

| | | | |
|---|---|---|---|
| 4,438,962 | 3/1984 | Soloviff | 292/144 |
| 5,040,391 | 8/1991 | Lin | 70/277 |
| 5,544,507 | 8/1996 | Lin | 70/107 |
| 5,626,039 | 5/1997 | Solari | 70/279 |
| 5,782,118 | 7/1998 | Chamberlain | 70/279 |
| 5,837,365 | 1/1999 | Armstrong | 70/279 |

*Primary Examiner*—Darnell M. Boucher
*Assistant Examiner*—Gary Estremsky
*Attorney, Agent, or Firm*—Harness, Dickey & Pierce, P.L.C.

[57] ABSTRACT

An electrically operable tubular lock assembly includes a support to be mounted on an inner side of a door, a hollow cylinder having an outer end mounted on the support and an inner end extending inwardly from the support, a spindle extending axially inside the hollow cylinder and connected to the hollow cylinder for simultaneous rotation therewith, a rotary handle body connected to the inner end of the hollow cylinder, a driving wheel mounted on the support around the hollow cylinder and having a first gear part adjacent to the support and a second gear part adjacent to the handle body, an electric motor mounted on the support adjacent to and externally of the driving wheel, a first transmission mechanism mounted on the support and connected to the first gear part and the motor, and a second transmission mechanism mounted inside the handle body and connected to the second gear part and the spindle.

8 Claims, 6 Drawing Sheets

ELECTRICALLY OPERABLE TUBULAR LOCK

BACKGROUND OF THE INVENTION

1. Field of the Invention

The invention relates to a door lock, more particularly to a tubular lock that incorporates an electrically operated driving wheel to control the latching and unlatching operations of the tubular lock.

2. Description of the Related Art

Various forms of tubular locks have existed in the art. FIG. 1 shows a typical tubular lock 10 which comprises an outer handle body 11 adapted to be mounted on the outer side of a door, and an inner handle body 12 adapted to be mounted on the inner side of the door. The outer and inner handle bodies 11 and 12 are interconnected by a spindle 13 which passes through a spindle hole of a latch mechanism (not shown) and which incorporates a mandrel 131 therein. The mandrel 131 is connected to a knob body 121 disposed inside the inner handle body 12. The spindle 13 also passes through a spindle hole 123 of a rotatable hollow cylinder 122. When the knob body 121 is turned manually, the mandrel 131 will move a locking element (not shown) disposed in the outer handle body 11 so that the hollow cylinder 122 and the spindle 13 are locked against rotation. In this situation, the tubular lock 10 is in a locked position. If the mandrel 131 is turned in a reversed direction, the locking element is moved to a releasing position, thereby releasing the cylinder 122 and the spindle 13 and unlocking the tubular lock 10. On the other hand, when the handle body 12 is rotated, the cylinder 122 and the spindle 13 can be turned to actuate the latch mechanism so that the door can be latched or unlatched. As mentioned hereinabove, conventional tubular locks generally comprise a mandrel and a spindle which interconnect inner and outer handle bodies or levers and which are operable only through a manual operation. Improvements are therefore desirable so as to render conventional tubular locks operable via electric means.

SUMMARY OF THE INVENTION

An object of the present invention is to provide a tubular lock which can be operated either manually or electrically.

According to the present invention, a tubular lock assembly for actuating a latch mechanism, comprises a support adapted to be mounted on an inner side of a door, a hollow cylinder having an outer end mounted on the support and an inner end extending inwardly from the support, a spindle extending axially inside the hollow cylinder and connected to the hollow cylinder for simultaneous rotation, the spindle being adapted to be connected to the latch mechanism, a rotary handle body connected to the inner end of the hollow cylinder, a driving wheel mounted on the support around the hollow cylinder and having a first gear part adjacent to the support and a second gear part adjacent to the handle body, an electric motor mounted on the support adjacent to and externally of the driving wheel, a first transmission mechanism mounted on the support and connected to the first gear part and the motor, and a second transmission mechanism mounted inside the handle body and connected to the second gear part and the spindle. The tubular lock assembly further includes a control unit to control the motor so as to limit the driving wheel to rotate within a limited angle.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENTS

Figure 1:
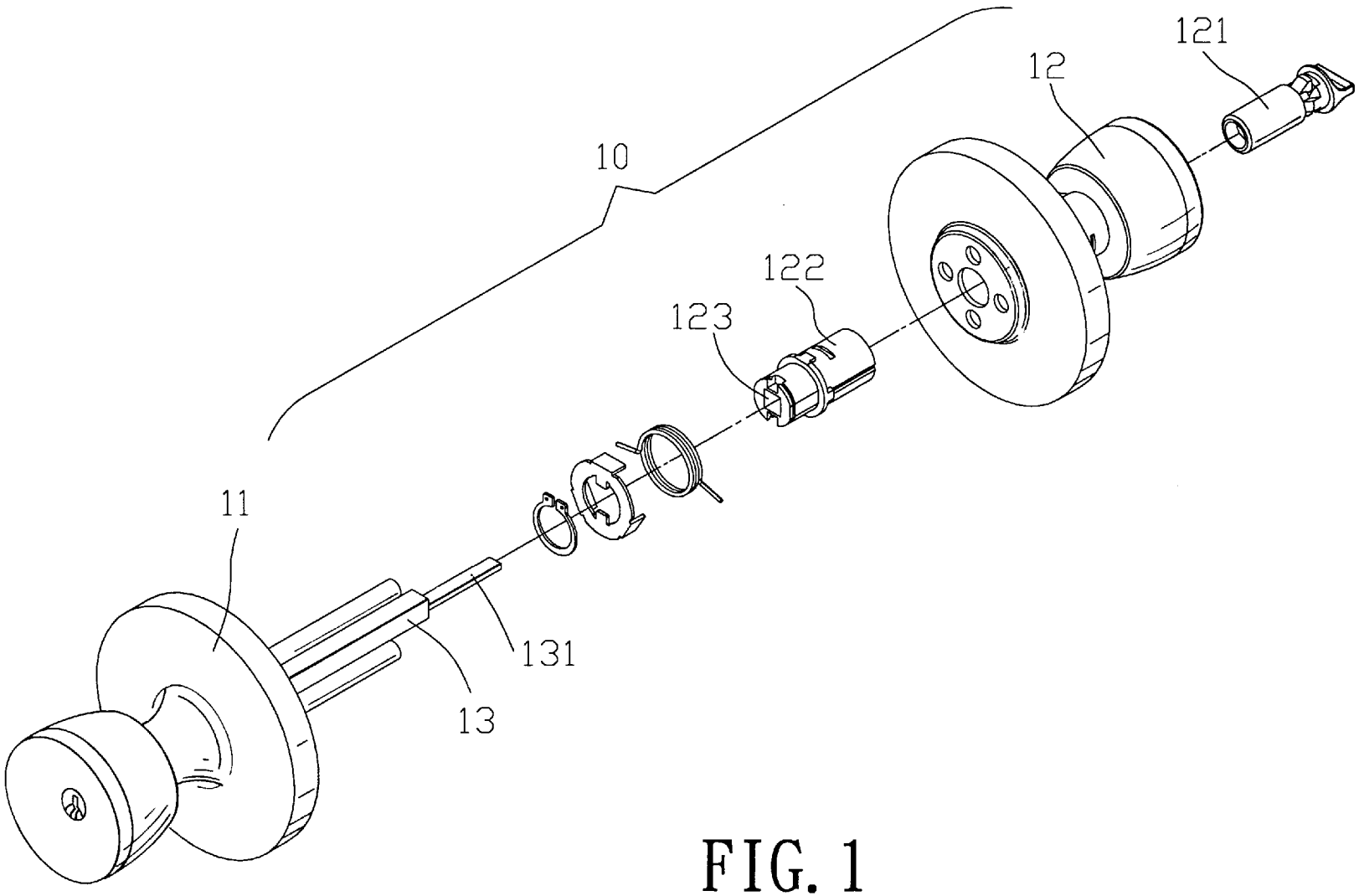
FIG. 1 PRIOR ART
FIG. 1 shows a conventional tubular lock.
Figure 2:
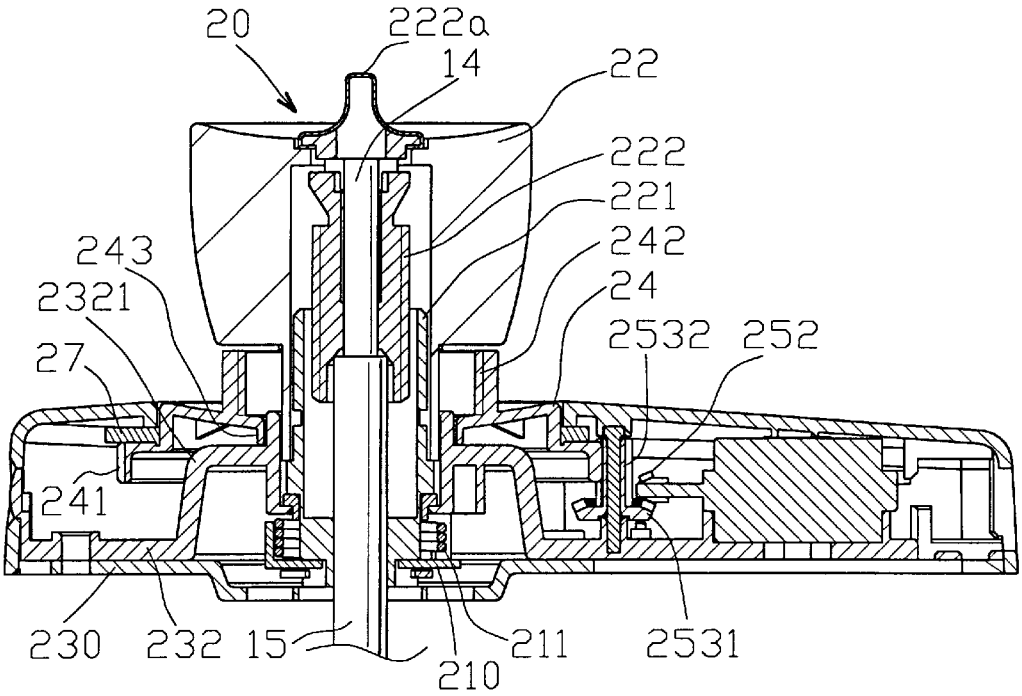
FIG. 2 sectional side view of a first preferred embodiment of a tubular lock according to the present invention.
Figure 3:
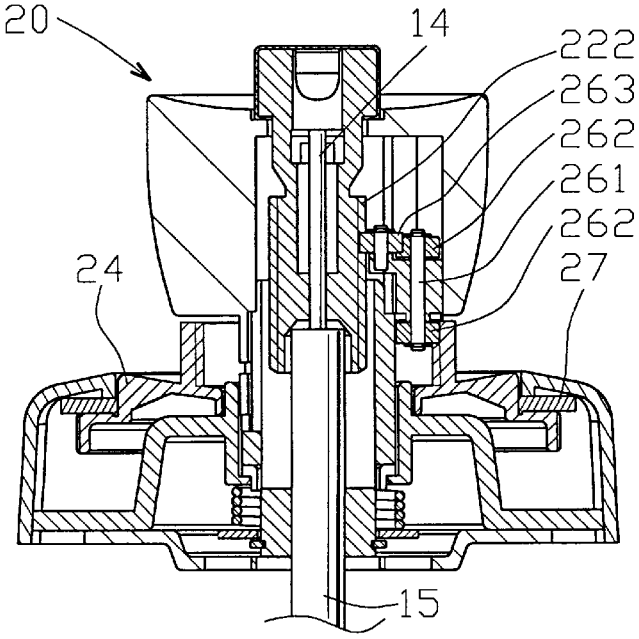
FIG. 3 is a sectional top view of the first embodiment.
Figure 4:
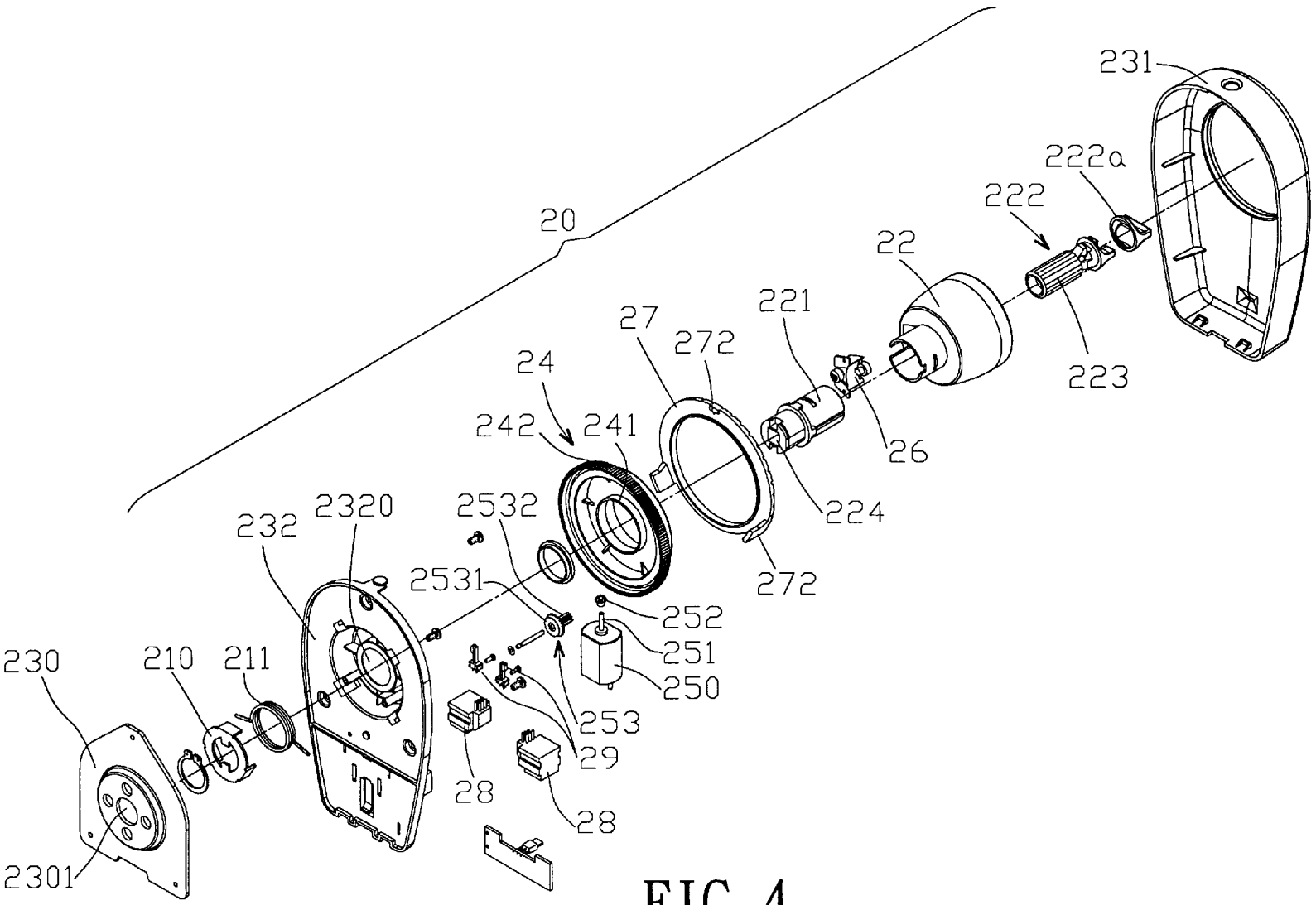
FIG. 4 is an exploded view of the first embodiment.

Referring to FIGS. 2, 3 and 4, a tubular lock embodying the present invention is designated by numeral 20 and includes a support formed by a cover 231 and a base 232 which are coupled together via interlocking means (not shown). A positioning plate 230 is fixed to the base 231 opposite to the cover 231. A hollow cylinder 221 is mounted rotatably on the base 232 and extends into a hole 2320 of a cup portion 2321 of the base 232. An inner end of the hollow cylinder 221, which will be located at an inner side of the door, is connected to a rotary handle body 22 which incorporates a turning knob body 222. The outer end of the cylinder 221 has a rectangular spindle hole 224 for passage of a rotary spindle 15 which is adapted to connect with a latch mechanism (not shown) that will be mounted inside a door. In this embodiment, the spindle 15 has a rectangular cross-section to engage the spindle hole 224 of the cylinder 221 so that the spindle 15 can be turned via rotation of the rotary handle 22 and the cylinder 221 SO as to latch or unlatch the door in a conventional way.

A torsion spring 211 and a restraining plate 230 are sleeved around the outer end of the hollow cylinder 221 between the base plate 232 and the positioning plate 230. As in the conventional tubular lock, the torsion spring 22 cooperates with the restraining plate 230 and controls the rotation of the hollow cylinder 221 SO that, after the cylinder 221 is turned in one direction, it can be returned to its original position by the action of the torsion spring 211.

The spindle 15, which is shown partially in FIGS. 2 and 3, will extend towards the outer side of the door from a hole 2301 of the positioning plate 230 SO as to connect with the latch mechanism and an outer handle body (not shown) which will be mounted on the outer side of the door. There will be a locking element (not shown) associated with the outer handle body for locking the spindle 15 against rotation. The spindle 15 has a mandrel 14 which extends into the handle body 22 and is inserted fittingly in the knob body 222. The knob body 222 is in the form of a sleeve body and is provided with a plurality of axially extending gear teeth 223. A knob cap 222*a* is connected to the knob body 222 and projects outward from the handle body 22. When the mandrel 14 is turned via the knob body 222, the spindle 15 can be released from the aforesaid locking element and permitted to operate the latch mechanism in a conventional way.

A driving wheel 24 is disposed around the cylinder 221 and has a rim 243 mounted on a cup portion 2321 of the base plate 232. The driving wheel 24 has a varying cross-section. An internal gear part 241 is formed at one end of the driving wheel 24 adjacent to the handle body 22, and an external gear part 242 is formed at the other end of the driving wheel 24. The cross-section of the external gear part 242 is greater than that of the internal gear part 241. A motor 250 is mounted on the base plate 232 to operate the driving wheel 24 via a first transmission mechanism. In this embodiment, the first transmission mechanism includes a bevel gear 252 mounted on an output shaft 251 of the motor 250, and a gear 253 mounted on the base plate 232 adjacent to the bevel gear 252 and including a bevel gear part 2531 and a spur gear part 2532. The bevel gear part 2531 engages the bevel gear 252, while the spur gear part 2532 engages the external gear part 242 of the driving wheel 24 so as to drive the driving wheel 24.

The internal gear part 241 of the driving wheel 24 is connected to the knob body 222 via a second transmission mechanism 26 so as to rotate the knob body 222. In this embodiment, the second transmission mechanism 26 is mounted inside the handle body 22 and includes a transmission shaft 261, a pair of transmission gears 262 mounted on the transmission shaft 261 in an axially spaced apart position, and another transmission gear 263. One of the transmission gears 262 extends into and engages the internal gear part 241. The other transmission gear 262 engages the transmission gear 263 which in turn engages the gear teeth 223 of the knob body 222. Via the second transmission mechanism 26, the motion of the driving wheel 24 can be transmitted to the knob body 222 and the mandrel 14 which will then move the spindle 15 to latch or unlatch the door. As such, the door can be latched or unlatched by energizing the motor 250.

Figure 6:
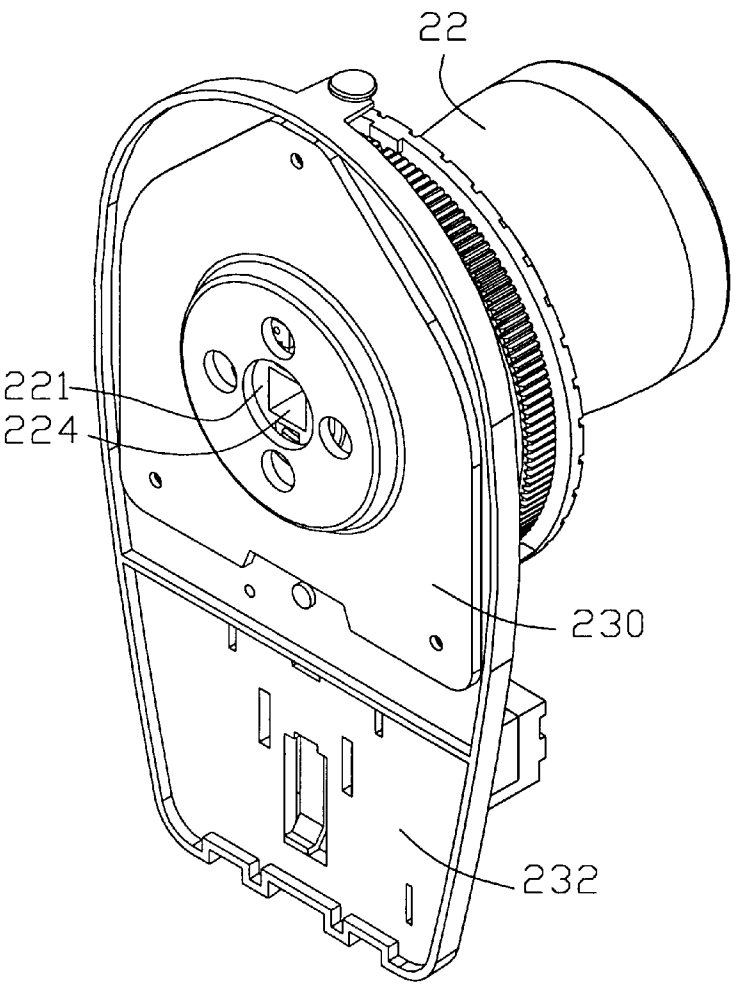
FIG. 6 is a rear perspective view of the first embodiment.
Figure 5:
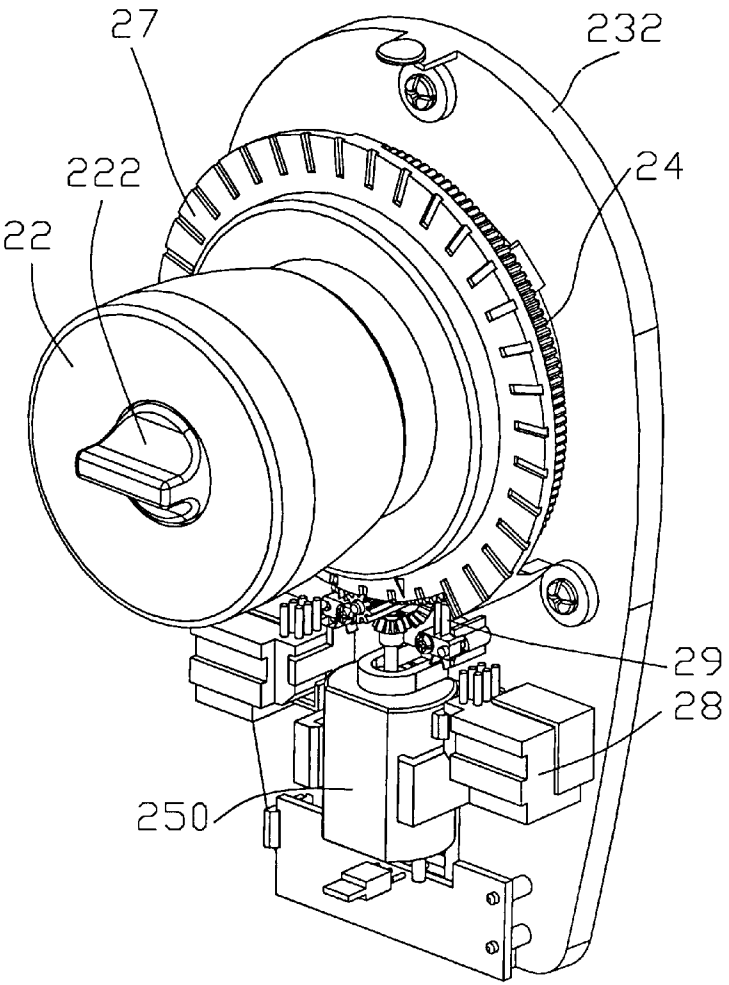
FIG. 5 is a front perspective view of the first embodiment.

Referring to FIGS. 5 and 6 in combination with FIG. 4, a control unit for controlling and limiting the rotation of the driving wheel 24 includes a hollow limit plate 27 disposed around and connected to the driving wheel 24 for simultaneous rotation therewith, and a pair of micro-switches 29. The micro-switches 29 are mounted on the base plate 232 on two sides of the motor 250. The limit plate 27 is provided with axially projecting tongues 272 adjacent to the external gear part 241, and the tongues 272 function to contact and actuate the micro-switches 29. When the motor 250 is energized, the driving wheel 24 is rotated, and one of the tongues 272 will move to and then contact one of the micro-switches 29, thereby de-energizing the motor 250 and limiting the driving wheel 24 to rotate within a limited angle. The control unit further includes a pair of electric connectors 28 which are connected electrically to the micro-switches 29, respectively. The electric connectors 28 are also mounted on the base plate 232 and can be connected to an external control circuit (not shown), such as a coded control circuit, for remote control of the cylinder lock 20 of the present invention.

Figure 7:
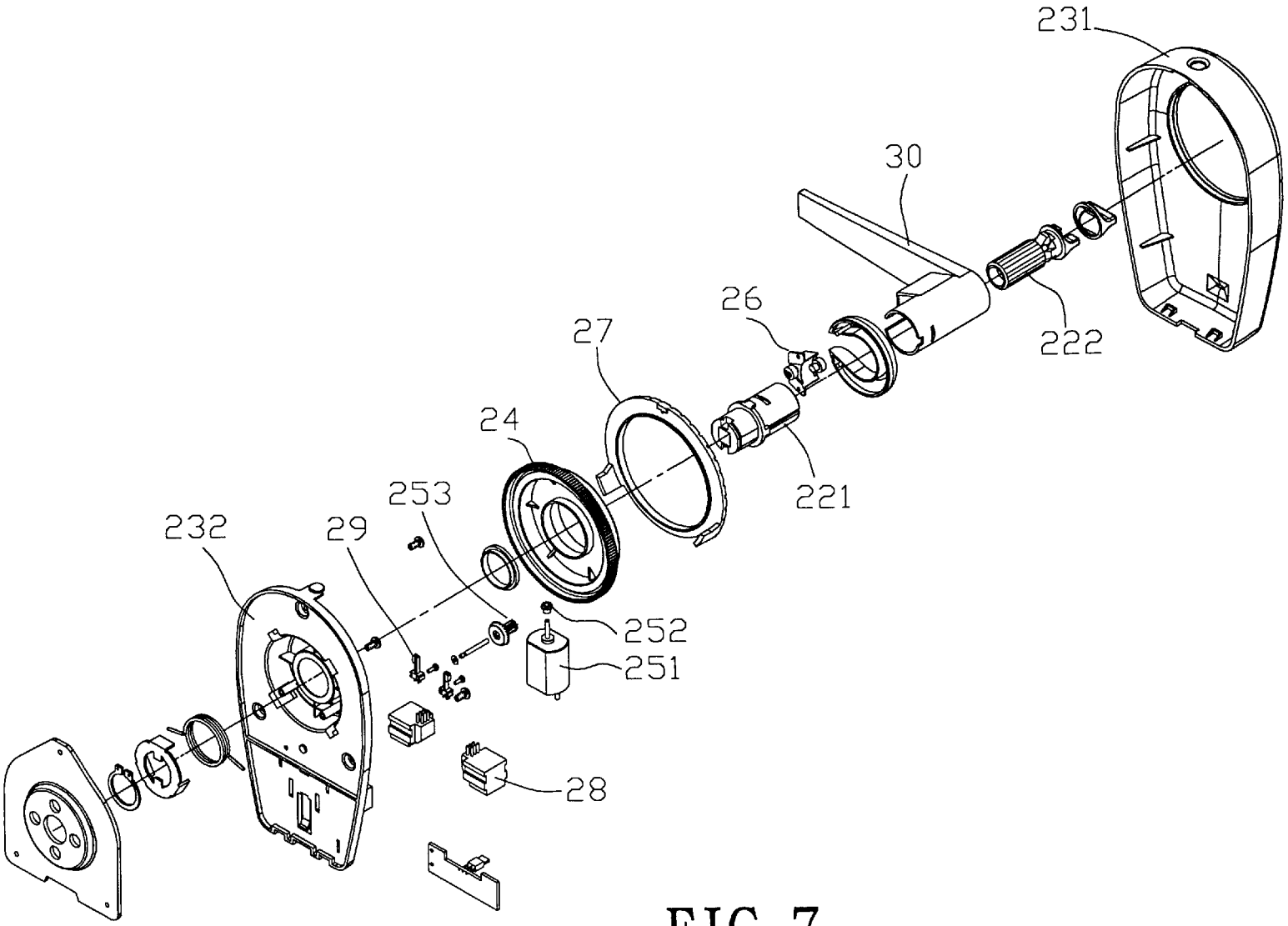
FIG. 7 shows an exploded view of a second preferred embodiment of the present invention.
Figure 9:
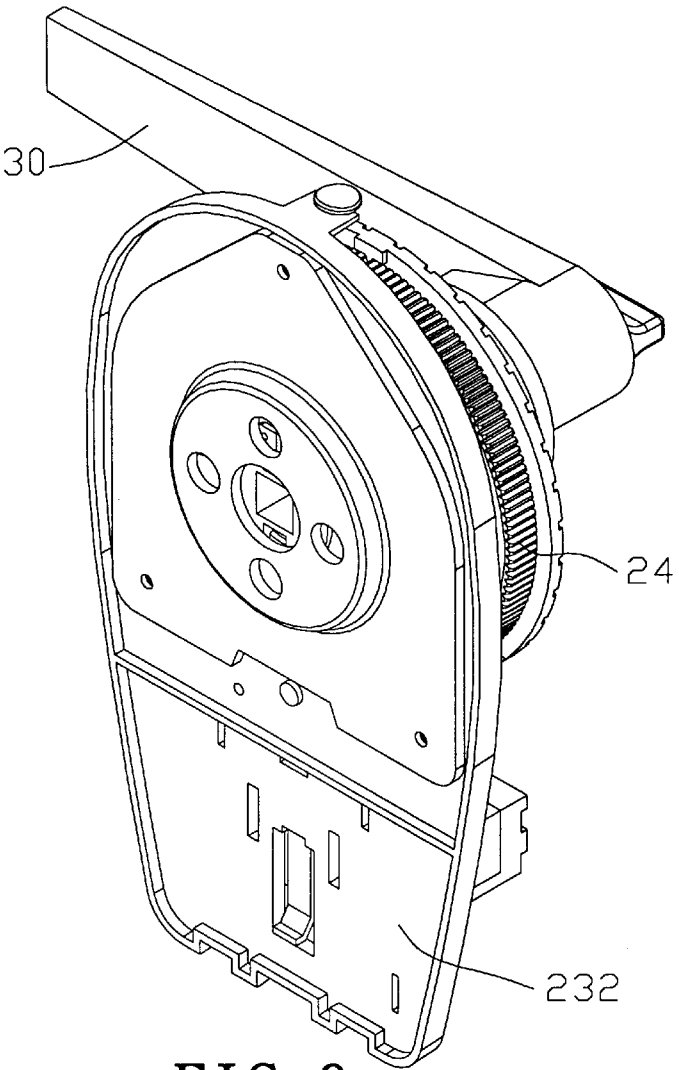
FIG. 9 is a rear perspective view of the second embodiment.
Figure 8:
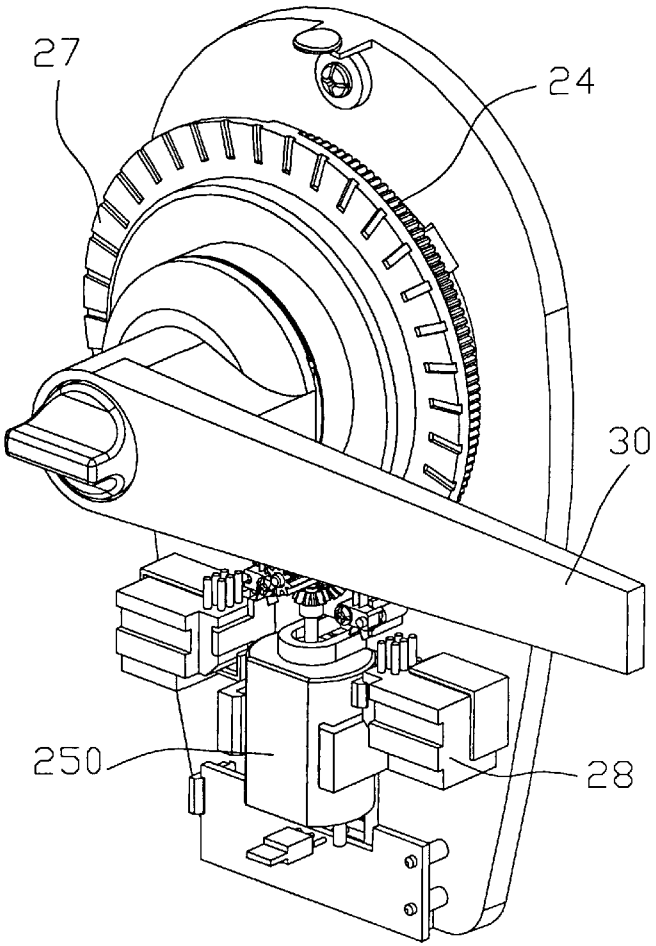
FIG. 8 is a front perspective view of the second embodiment.

A second preferred embodiment of the present invention is shown in FIGS. 7 and 8, wherein elements similar to those illustrated in the previous embodiment are represented by like numerals. The second embodiment differs from the previous embodiment only in that a lever handle 30 is used in the second embodiment in place of the handle body 22 of the previous embodiment.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A tubular lock assembly for actuating a door latch mechanism, comprising:

a support adapted to be mounted on on an inner side of a door;

a hollow cylinder having an outer end mounted on said support and an inner end extending inwardly from said support;

a spindle extending axially inside said hollow cylinder and connected to said hollow cylinder for simultaneous rotation therewith, said spindle being adapted to be connected to the latch mechanism;

a rotary handle body connected to said inner end of said hollow cylinder;

a driving wheel mounted on said support around said hollow cylinder and having a first gear part adjacent to said support and a second gear part adjacent to said handle body;

an electric motor mounted on said support adjacent to and externally of said driving wheel;

a first transmission mechanism mounted on said support and connected to said first gear part and said motor; and a second transmission mechanism mounted inside said handle body and connected to said second gear part and said spindle.

2. The tubular lock assembly as claimed in claim 1, further comprising a control unit to control said motor so as to limit said driving wheel to rotate within a limited angle.

3. The tubular lock assembly as claimed in claim 2, wherein said driving wheel is hollow and has a varying cross-section, said first gear part is an external gear part, and said second gear part is an internal gear part, said external gear part having a cross-section greater than that of said internal gear part.

4. The tubular lock assembly as claimed in claim 3, wherein said second transmission mechanism includes a transmission shaft mounted inside said handle body adjacent to said spindle and extending into said internal gear part axially of said spindle, and transmission gears mounted on said transmission shaft and driven by said internal gear part.

5. The tubular lock assembly as claimed in claim 4, further comprising a knob body sleeved around said spindle inside said handle body, said knob body having a periphery formed with axially extending gear teeth and being rotatable via said transmission gears.

6. The tubular lock assembly as claimed in claim 5, wherein said knob body has a manually operable knob cap connected thereto and projecting from said handle body to the inner side of the door.

7. The tubular lock assembly as claimed in claim 5, wherein said first transmission mechanism includes transmission gears which are connected to said motor and said external gear part.

8. The tubular lock assembly as claimed in claim 3, wherein said control unit includes a hollow limit plate disposed around said driving wheel for simultaneous rotation therewith and having tongues extending adjacent to said external gear part, and a micro-switch mounted on said base plate adjacent to said external gear part and electrically connected to said motor, said micro-switch being actuated by said tongues to control said motor.

* * * * *